US010895094B2

(12) United States Patent
Li et al.

(10) Patent No.: US 10,895,094 B2
(45) Date of Patent: Jan. 19, 2021

(54) AUTOMATED DOOR LOCK

(71) Applicants: Clark Li, Thousand Oaks, CA (US); Chunmeng Han, Thousand Oaks, CA (US)

(72) Inventors: Clark Li, Thousand Oaks, CA (US); Chunmeng Han, Thousand Oaks, CA (US)

(73) Assignee: Consumer 2.0, Inc., Los Angeles, CA (US)

( * ) Notice: Subject to any disclaimer, the term of this patent is extended or adjusted under 35 U.S.C. 154(b) by 351 days.

(21) Appl. No.: 16/124,973

(22) Filed: Sep. 7, 2018

(65) Prior Publication Data

US 2020/0080342 A1 Mar. 12, 2020

(51) Int. Cl.
*E05B 47/00* (2006.01)

(52) U.S. Cl.
CPC ..... *E05B 47/0001* (2013.01); *E05B 47/0046* (2013.01); *E05B 2047/0068* (2013.01)

(58) Field of Classification Search
CPC ..... E05B 47/0001; E05B 47/0046; E05B 2047/0051; E05B 2047/0068; E05B 2047/0069; E05B 2047/0067
USPC .. 70/432–434, 441, 450, DIG. 59, 276, 277, 70/278.1–278.7, 336; 292/336.3, 144, 292/201
See application file for complete search history.

(56) References Cited

U.S. PATENT DOCUMENTS 3,803,575 A * 4/1974 Gotanda ..... E05B 45/083 340/522
4,573,720 A * 3/1986 Nicolai ..... E05B 47/00 292/144
4,904,005 A * 2/1990 Frolov ..... E05B 45/06 292/144
5,925,861 A * 7/1999 Fromberg ..... E05B 15/1621 200/61.67
6,318,138 B1 * 11/2001 Mathews ..... E05B 47/0012 292/144
6,580,355 B1 * 6/2003 Milo ..... E05B 47/0012 340/5.7
7,377,560 B2 * 5/2008 Wiemer ..... E05C 19/16 292/251.5
8,381,558 B2 * 2/2013 Alef ..... E05B 47/02 70/280
9,187,929 B2 * 11/2015 Webb ..... E05C 1/16
(Continued)

FOREIGN PATENT DOCUMENTS

GB 2348311 * 9/2000 ..... E05B 45/06

*Primary Examiner* — Suzanne L Barrett
(74) *Attorney, Agent, or Firm* — Douglas L. Weller

(57) ABSTRACT

An automated door lock includes a bolt and bolt housing. A lock interior part is attachable to an inside portion of a door. The lock interior part includes control logic that controls operation of automated door lock including movement of the bolt into and out of the bolt housing. A first lock plate is attachable to a door frame. The first lock plate includes a magnet. The second lock plate is attachable to a door. The second lock plate includes a sensor electrically connected to the control logic. The sensor detects magnetic field strength. The magnet is located on the first lock plate and the sensor is located on the second plate so that when the door is closed, the sensor and the magnet are aligned to maximize strength of the magnetic field detected by the sensor.

16 Claims, 5 Drawing Sheets

(56) References Cited

U.S. PATENT DOCUMENTS

| | | | | |
|---|---|---|---|---|
| 2017/0234033 | A1* | 8/2017 | DeBoer | E05C 1/06 49/449 |
| 2017/0292290 | A1* | 10/2017 | Schildwachter | E05B 47/0047 |
| 2019/0024412 | A1* | 1/2019 | Lammers | E05B 15/0205 |

* cited by examiner

AUTOMATED DOOR LOCK

BACKGROUND

Automated door locks, often referred to as smart locks, allow keyless entry to homes. A smart lock is often designed to be attached to an existing door knob or existing deadbolt. A wireless connection to a smart phone or a keypad can used to lock and unlock doors. The wireless connection can also be used to communicate the current state of the door, for example, whether door is open, shut or shut and locked. Door activity, including when the door is opened, shut and locked can be tracked. A camera can be added to record video or photos of those entering and exiting through the door. Visitors can be granted keyless entry through use of an application running on a smart phone.

DETAILED DESCRIPTION

Figure 1:
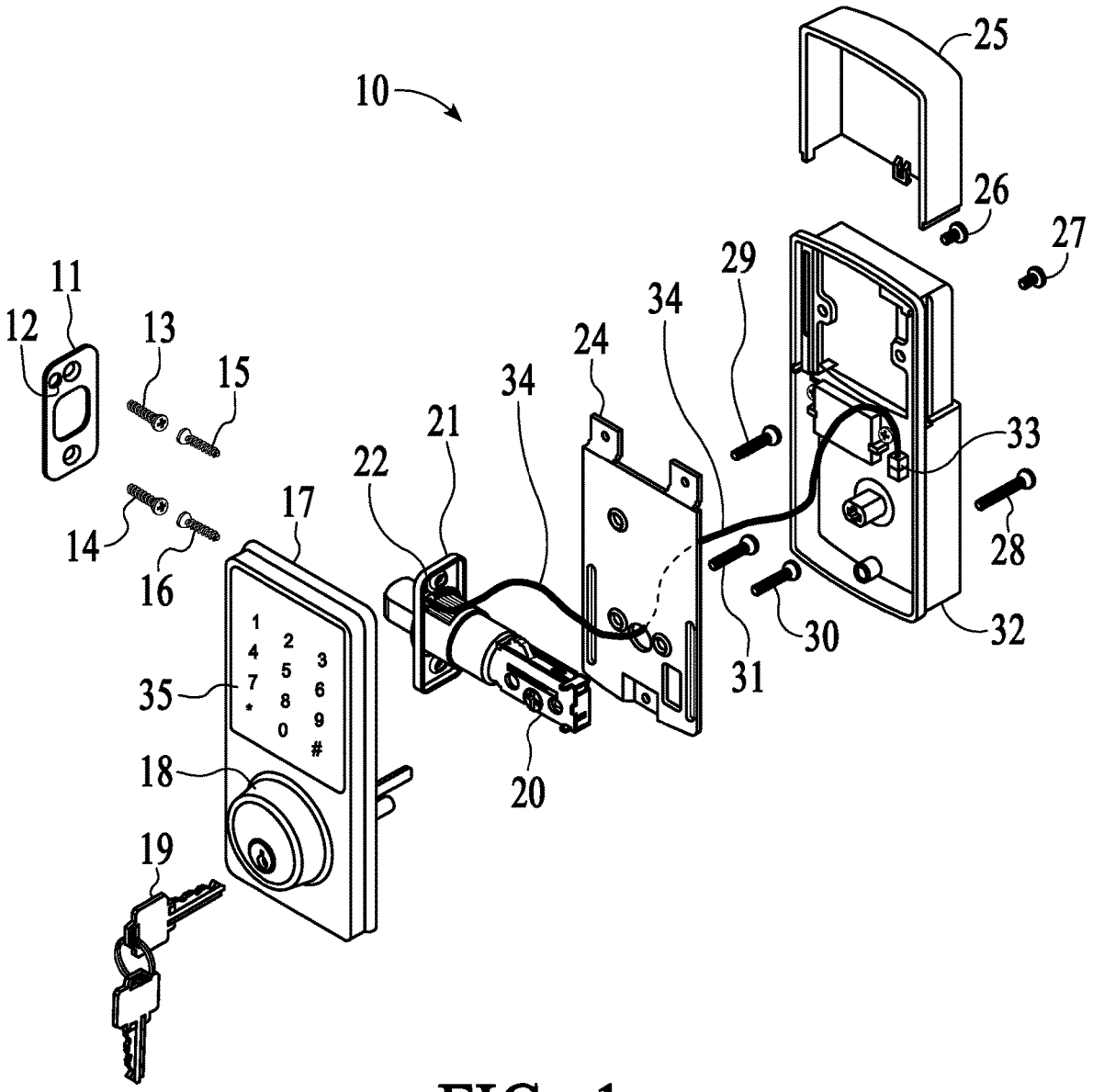
FIG. 1 is a simplified exploded view of an automated door lock that includes a lock plate sensor in accordance with an implementation.

FIG. 1 is a simplified exploded view of an automated door lock 10. A lock plate 11 is attached to a door frame using a screw 13 and a screw 14. Lock plate 11 includes a magnet 12. Bolt housing 20 houses a bolt 23. For example, bolt 23 may be a deadbolt or a spring bolt. Bolt housing 20 is mounted through a lock plate 21 that includes a sensor 22 attached to wires 34. A screw 15 and a screw 16 are used to anchor hold lock plate 21 firmly to a door. A lock exterior part 17 placed on an outside of a door includes a lock body 18 having a keyhole into which may be inserted a key 19. A key panel 35 may be used to unlock automated door lock 10 without the use of a key.

A mounting plate 24, located on the inside of a door, is attached using a screw 30 and a screw 31 that extend through mounting plate 24, through holes in bolt housing 20 through the door in order to screw into matching holes in lock exterior part 17. Additionally, a screw 29 extends through mounting plate 24 and through the door screws into a matching hole in lock exterior part 17. More or fewer screws may be utilized.

A lock interior part 32 is attached to mounting plate 24 using a screw 26, a screw 27 and a screw 28. A cover 25 snaps onto lock interior part 32. A connection receptor 33 receives a connector at an end of wires 34 allowing sensor 22 to be electrically connected to control logic of automated door lock 10, which is housed within lock interior part 32.

Figure 2:
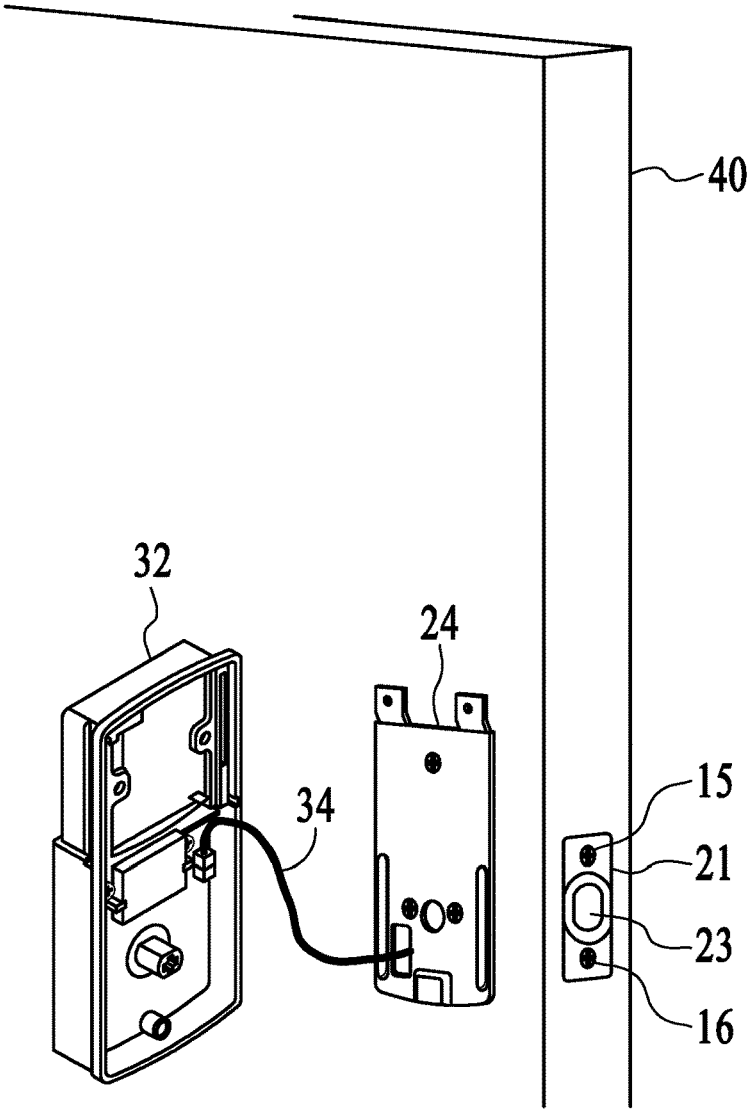
FIG. 2 shows a partially assembled automated door lock that includes a lock plate sensor in accordance with an implementation.

FIG. 2 shows bolt 23 visible through lock plate 21 mounted on a door 40 using screw 15 and screw 16. Wires 34 extend from sensor 22 through mounting plate 24 and are attached to connection receptor 33 allowing sensor 22 to be electrically connected to the control logic of automated door lock 10 housed within lock interior part 32.

Figure 3:
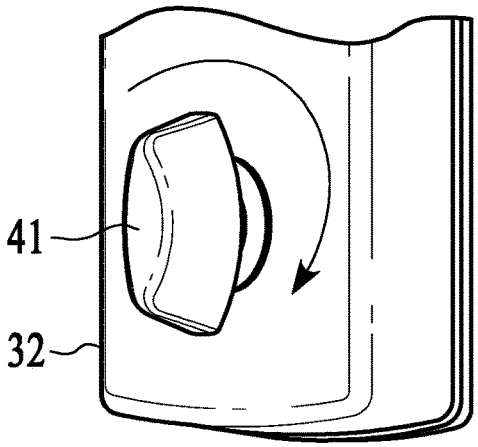
FIG. 3 shows a back knob located on an assembled automated door lock that includes a lock plate sensor in accordance with an implementation.

FIG. 3 shows a back knob 41 located on the outside of lock interior part 32. Knob 41 allows someone located at the interior to manually lock automated door lock 10.

Figure 4:
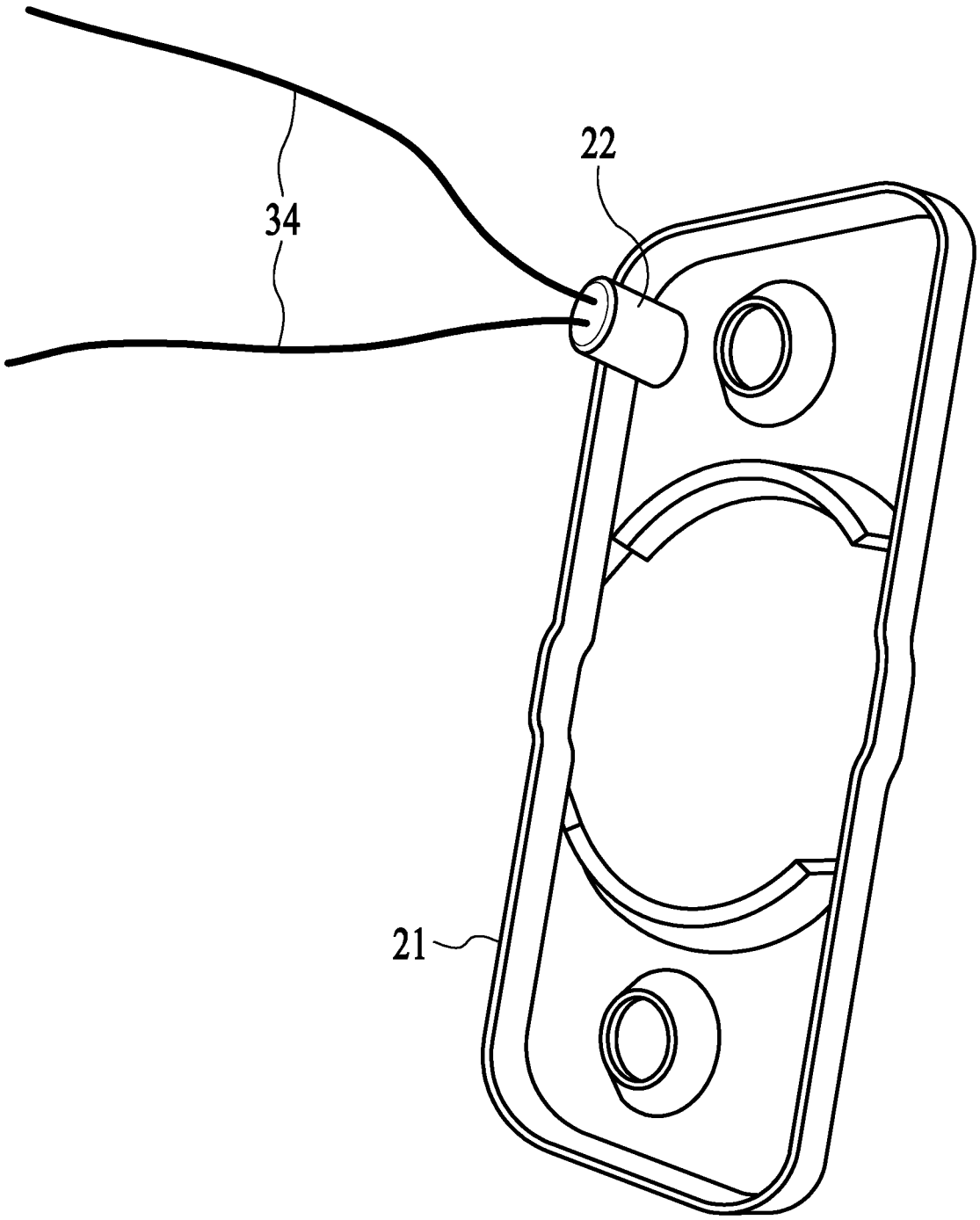
FIG. 4 and FIG. 5 show various views of a lock plate that includes a sensor in accordance with an implementation.
Figure 5:
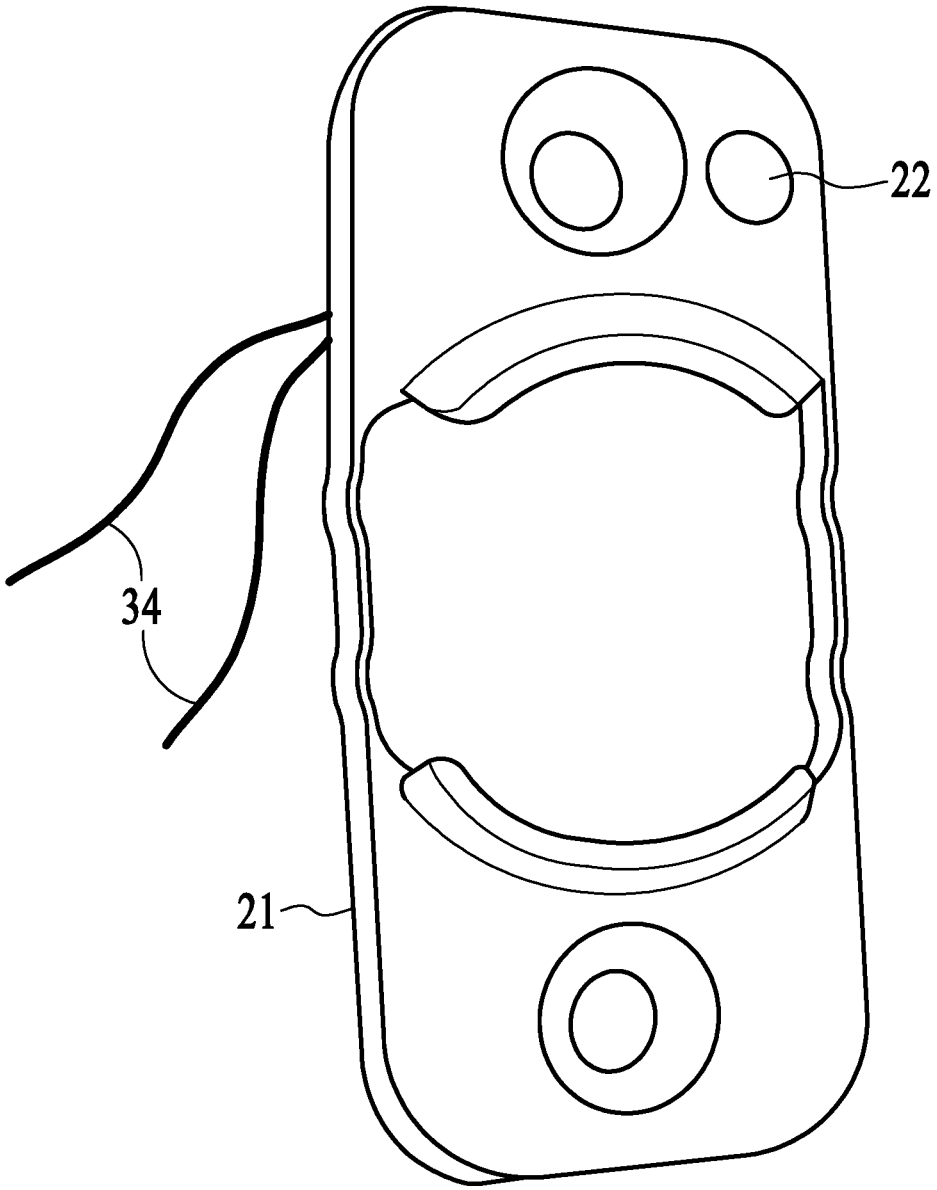

FIG. 4 and FIG. 5 show close-up views of sensor 22 mounted on lock plate 21.

Figure 6:
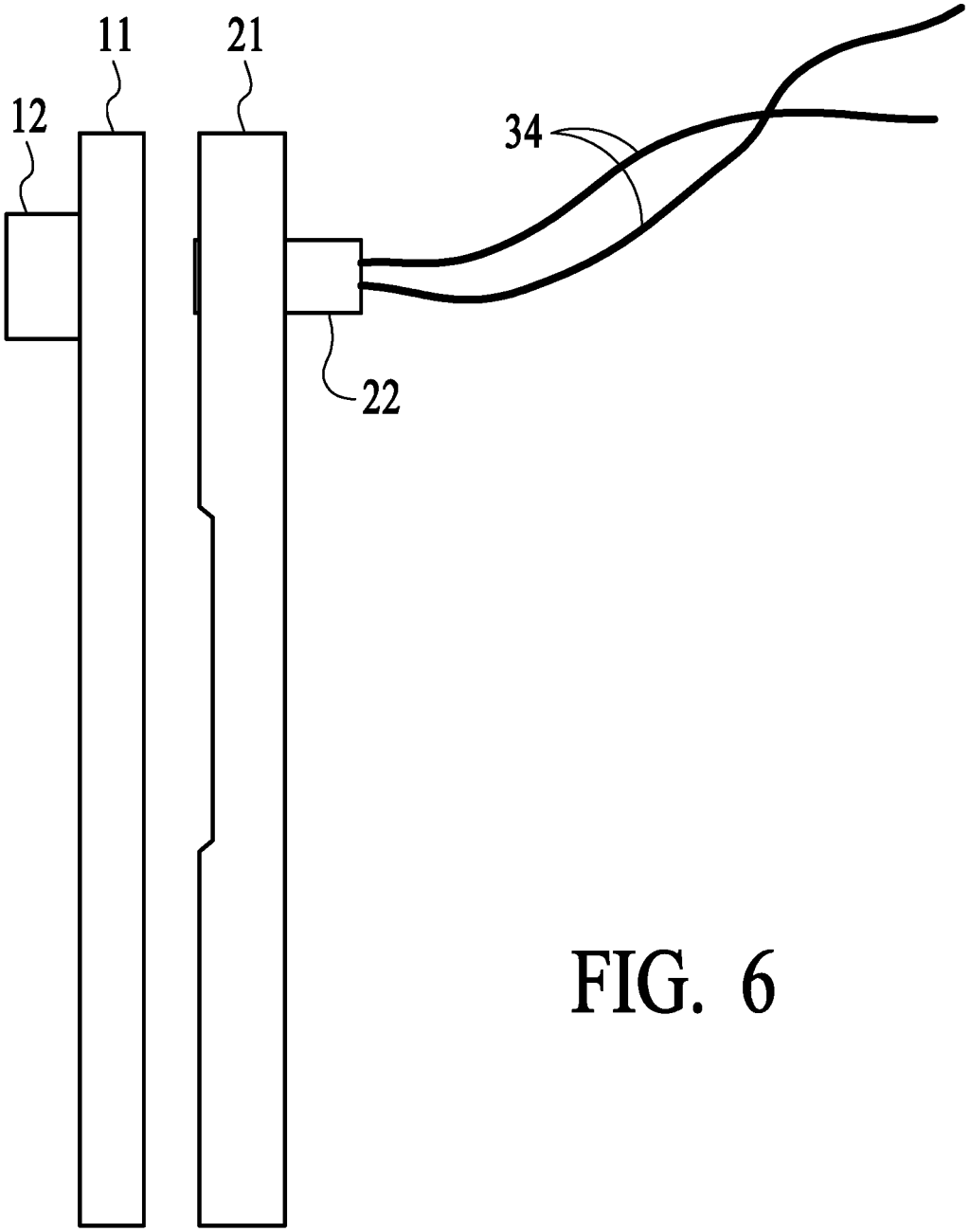
FIG. 6 shows a magnet mounted on a lock plate in accordance with an implementation.

FIG. 6 shows a location of magnet 12 on lock plate 11. As illustrated by FIG. 6, magnet 12 is located on lock plate 11 so that when a door is closed, magnet 12 is adjacent to sensor 22 mounted on lock plate 21. This allows sensor 22 to detect when the door is completely closed. That is, when the door is completely closed, the field produced by magnet 12 is at a maximum strength as detected by sensor 22. The resulting signal, transmitted through wires 34 to the control logic of automated door lock 10 allows the control logic to recognize when the door is fully closed. The control logic of automated door lock 10 can use this information to control functionality of automated door lock 10.

For example, sensor 22 is a reed switch operated by an applied magnetic field. The reed switch, for example, includes a pair of contacts on ferromagnetic metal reads. The metal reeds are, for example, hermetically sealed in a glass envelope. For example, the contacts are normally open and are closed when the door is closed resulting in magnet 12 being in close proximity to sensor 22. Once the door is opened, magnet 12 is pulled away from sensor 22 and the metal reeds return to their normally open position. Alternatively, the contacts are normally closed and are when the door is closed resulting in magnet 12 being in close proximity to sensor 22. Once the door is opened, magnet 12 is pulled away from sensor 22 and the metal reeds return to their normally closed position.

For example, in one mode, when input from sensor 22 indicates to the control logic recognizes that the door is completely shut, automated door lock 10 can automatically lock the door. This feature is especially helpful when bolt 23 is a deadbolt. For example, motors within lock interior part 32 are used to extend bolt 23 out of bolt housing 20 into a locking position.

When input from sensor 22 indicates to the control logic that the door is not completely shut, automated door lock 10 can notify a user. For example, the notification can be local through a light or sound. The notification can also be communicated to a remote user through an indicator on a smart phone application that the door is ajar. The notification can also be used to track at what times the door is open and at what time the door is completely shut.

Locating a magnet on a first lock plate and a sensor on a second plate allows the sensor system to be hidden so that when the door is closed, there is not an external sensor system that is visible to a user on either the inside of the door or the outside of the door.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. An automated door lock, comprising:

a bolt;

bolt housing configured for placement within a door;

a mounting plate that is attachable to an interior facing surface of the door;

a lock interior part configured to be mounted on the mounting plate, the lock interior part including control logic that controls operation of automated door lock including movement of the bolt into and out of the bolt housing, the control logic including a connector receptor;

a first lock plate attachable to a door frame, the first lock plate including a magnet; and, a second lock plate attachable to a door, the second lock plate including a sensor electrically connected through wires to a connector, the sensor detecting magnetic field strength;

wherein the magnet is located on the first lock plate and the sensor is located on the second plate so that when the door is closed, the sensor and the magnet are aligned to maximize strength of the magnetic field detected by the sensor; and wherein the mounting plate includes a hole sized to allow the connector to be placed through the hole and inserted into the connector receptor when the lock interior part is ready to be mounted on the mounting plate.

2. An automated door lock as in claim 1, wherein the bolt is a dead bolt.

3. An automated door lock as in claim 1, wherein the bolt is a spring bolt.

4. An automated door lock as in claim 1, additionally comprising:

a lock exterior part attachable to an out portion of a door, the lock exterior part including a key panel and a lock body having a keyhole.

5. An automated door lock as in claim 1, additionally comprising:

a back knob located on an outside of the lock interior part so as to allow the automated door lock to be manually locked by an interior located user.

6. An automated door lock as in claim 1, wherein when input from the sensor indicates to the control logic that the door is completely shut, the automated door lock automatically locks the door.

7. An automated door lock as in claim 1, wherein when input from the sensor indicates to the control logic that the door is not completely shut, the automated door lock notifies a user through an indicator on a smart phone application.

8. An automated door lock as in claim 1, wherein the sensor is a reed switch.

9. A method for automating a door lock, comprising:

providing a bolt;

placing a bolt housing within a door;

attaching a mounting plate to an interior facing surface of the door mounting an interior lock port on the mounting plate, the lock interior part including control logic that controls operation of the door lock including movement of the bolt into and out of the bolt housing, the control logic including a connector receptor, attaching a first lock plate to a door frame, the first lock plate including a magnet; and, attaching a second lock plate to a door, the second lock plate including a sensor electrically connected to through wires to a connector, the sensor detecting magnetic field strength;

locating the magnet on the first lock plate and locating the sensor on the second plate so that when the door is closed, the sensor and the magnet are aligned to maximize strength of the magnetic field detected by the sensor inserting the connector through a hole in the mounting plate and inserting the into the connector receptor before the lock interior part is mounted on the mounting plate.

10. A method as in claim 9, wherein the bolt is a dead bolt.

11. A method as in claim 9, wherein the bolt is a spring bolt.

12. A method as in claim 9, additionally comprising:

attaching a lock exterior part to an out portion of a door, the lock exterior part including a key panel and a lock body having a keyhole.

13. A method as in claim 9, additionally comprising:

placing a back knob on an outside of the lock interior part so as to allow the automated door lock to be manually locked by an interior located user.

14. A method as in claim 9, wherein when input from the sensor indicates to the control logic that the door is completely shut, the automated door lock automatically locks the door.

15. A method as in claim 9, wherein when input from the sensor indicates to the control logic that the door is not completely shut, the automated door lock notifies a user through an indicator on a smart phone application.

16. A method as in claim 9, wherein the sensor is a reed switch.

* * * * *